United States Patent [19]

Phillips et al.

[11] 4,185,864

[45] Jan. 29, 1980

[54] REMOTELY CONTROLLED CYCLIC GRAPNEL HOOK APPARATUS

[75] Inventors: Lawrence M. Phillips, Olivenhain, Calif.; Marc A. Morinaga, Honolulu, Hi.

[73] Assignee: The United States of America as represented by the Secretary of the Navy, Washington, D.C.

[21] Appl. No.: 780,371

[22] Filed: Mar. 23, 1977

[51] Int. Cl.[2] ..... B66C 1/38

[52] U.S. Cl. ..... 294/83 R

[58] Field of Search ..... 294/83 R, 83 AB, 82 R, 294/78 R, 78 A, 86 R, 75, 110; 244/137 R

[56] References Cited

U.S. PATENT DOCUMENTS

| | | | |
|---|---|---|---|
| 2,673,116 | 3/1954 | Baird | 294/75 |
| 3,127,133 | 3/1964 | Glatfelter et al. | 294/83 R |
| 4,095,833 | 6/1978 | Lewis | 294/83 R |

*Primary Examiner*—James B. Marbert

*Attorney, Agent, or Firm*—Richard S. Sciascia; Ervin F. Johnston

[57] ABSTRACT

A remotely controlled cyclic grapnel hook apparatus includes a cylinder which has a top and a bottom, the cylinder having a central bore axially therethrough and a counterbore in its top portion. A piston is slidably mounted in the cylinder counterbore, and a piston rod connected to the piston is slidably mounted in the cylinder bore therebelow. The piston and piston rod are biased downwardly by a spring which may be located in the cylinder counterbore. The cylinder has a passageway to the bottom of the counterbore so that fluid pressure can be applied or released therein for moving the piston and piston rod up or down in the cylinder against the force of the spring. At least one hook is pivoted to the bottom of the cylinder so as to extend outwardly therefrom. The hook has a camming surface which engages the side of the piston rod so that the hook is locked in an upward load carrying position when the piston rod is in a downward position and is free to pivot downwardly to a load releasing position when the piston rod is moved upwardly. With this arrangement the hook apparatus can be remotely controlled to repeatedly pick up and drop various payloads.

9 Claims, 12 Drawing Figures

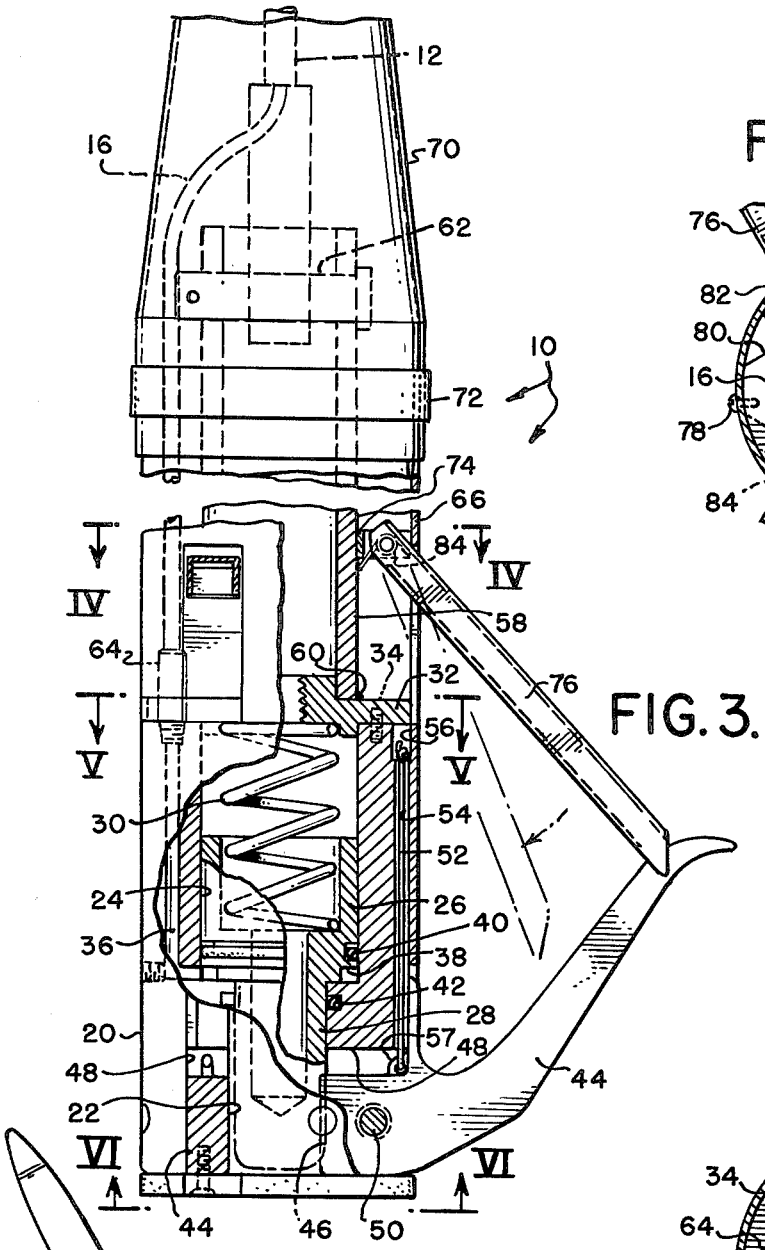
FIG. 3.
FIG. 4.
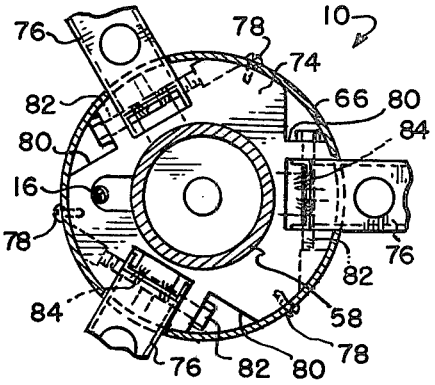
FIG. 5.
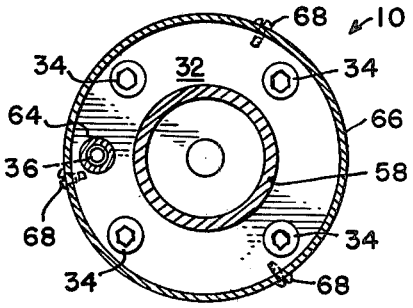
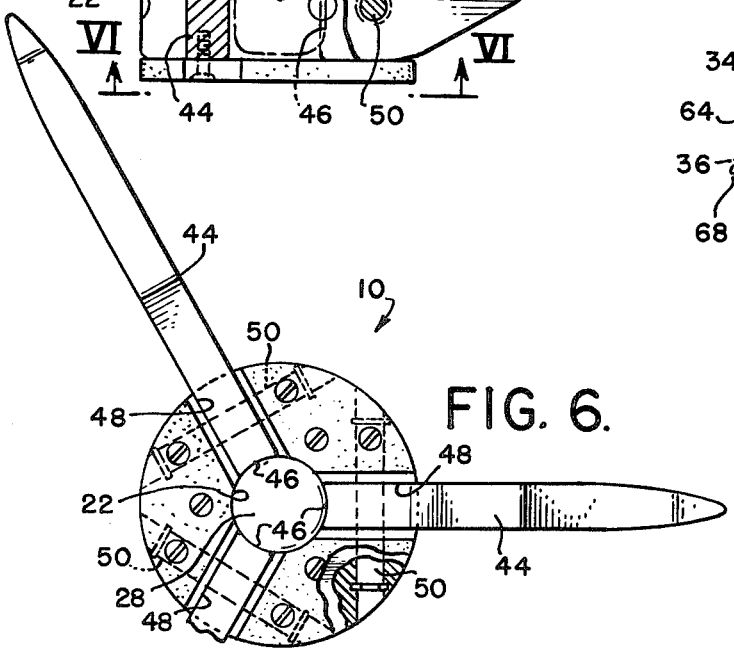
FIG. 6.

REMOTELY CONTROLLED CYCLIC GRAPNEL HOOK APPARATUS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to a grapnel hook apparatus which can be remotely controlled to repeatedly pick up and drop various payloads.

Helicopters are often utilized for picking up cargo from a surface location while the helicopter is in flight. This is accomplished by a tethered cargo hook which may be hooked into a loop which is provided on the payload. These hooks have been utilized for picking up a load and either hauling the load into the helicopter or dragging it through the air to drop at another location. These hooks have resulted in considerable hazard to ground support personnel who manually make connection between the hook and the cargo packages. Further, these hooks result in a tedious job for helicopter personnel who must haul the hook into the helicopter each time it is to be reset. The prior art system is especially unpracticable for picking up cargo packages from the surface of the ocean. There is an urgent need for a hook apparatus which can be remotely controlled by helicopter personnel to pickup and deliver cargo packages on a repeated basis without the necessity of manually recocking the hooking device.

SUMMARY OF THE INVENTION

The present invention has provided a hook apparatus which can be remotely controlled from an aircraft, such as a helicopter, for picking up and dropping cargo packages repeatedly without the necessity of manually recocking the hook apparatus. This has been accomplished by providing a cylinder which has a top and a bottom, the cylinder having a central bore axially therethrough and a counterbore in its top portion. A piston is slidably mounted in the cylinder counterbore and a piston rod connected to the piston is slidably mounted in the cylinder bore therebelow. A spring may be mounted in the counterbore for downwardly biasing the piston and the piston rod. The cylinder has a passageway to the bottom of the counterbore so that fluid pressure can be applied or released therein for moving the piston and piston rod up or down in the cylinder against the force of the spring. At least one hook is pivoted to the bottom of the cylinder so as to extend outwardly therefrom. The hook has a camming surface which engages the side of the piston rod so that the hook is locked in an upward load carrying position when the piston rod is in a downward position, and is free to pivot downwardly to a load releasing position when the piston rod is moved upwardly. With this arrangement, the hook apparatus is fully automatic by remote control to pickup and drop cargo packages on the ground surface or floating on the ocean by an aircraft while in flight.

STATEMENT OF THE OBJECTS OF INVENTION

An object of the present invention is to overcome the aforementioned problems associated with prior art hook apparatuses.

Another object is to provide a hook apparatus which can be remotely controlled for repeatedly picking up and dropping cargo packages.

A further object is to provide a hook apparatus which can be remotely controlled from an airborne vehicle for repeatedly picking up and releasing cargo packages from either the surface of the water or from a ground location without the necessity of manually recocking the hook apparatus.

These and other objects of the invention will become more readily apparent from the ensuing specification when taken together with the drawings.

BRIEF DESCRIPTION OF THE DRAWINGS

FIG. 3 is a side view of the hook apparatus with portions cut away to illustrate various details, the hook being shown in a locked upward load carrying position.

FIG. 4 is a cross-sectional view taken along plane IV—IV of FIG. 3.

FIG. 5 is a cross-sectional view taken along plane V—V of FIG. 3.

FIG. 6 is a cross-sectional view taken along plane VI—VI of FIG. 3.

DESCRIPTION OF THE PREFERRED EMBODIMENT

Figure 1A:
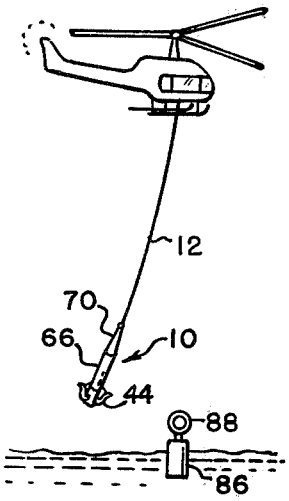
FIG. 1 illustrates elevational views of various steps in utilizing the hook apparatus for retrieving, carrying, and releasing a cargo package.
Figure 1B:
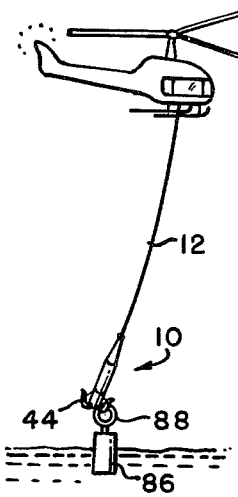
Figure 1C:
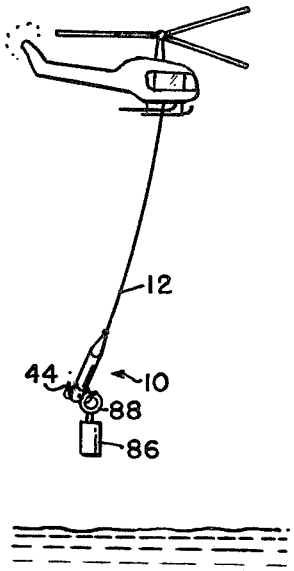
Figure 1D:
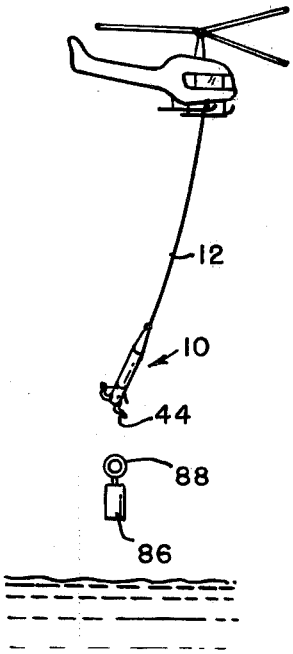
Figure 1E:
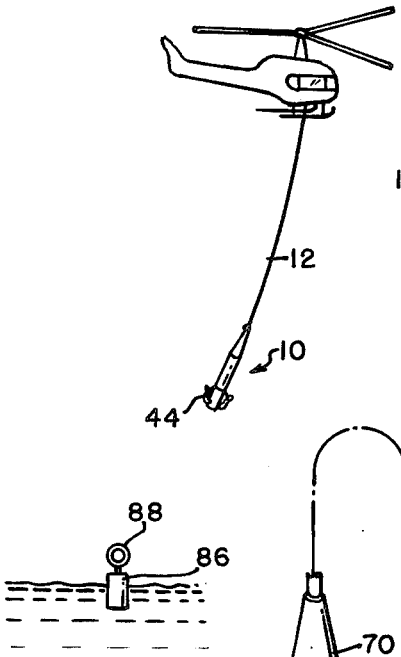
Figure 2:
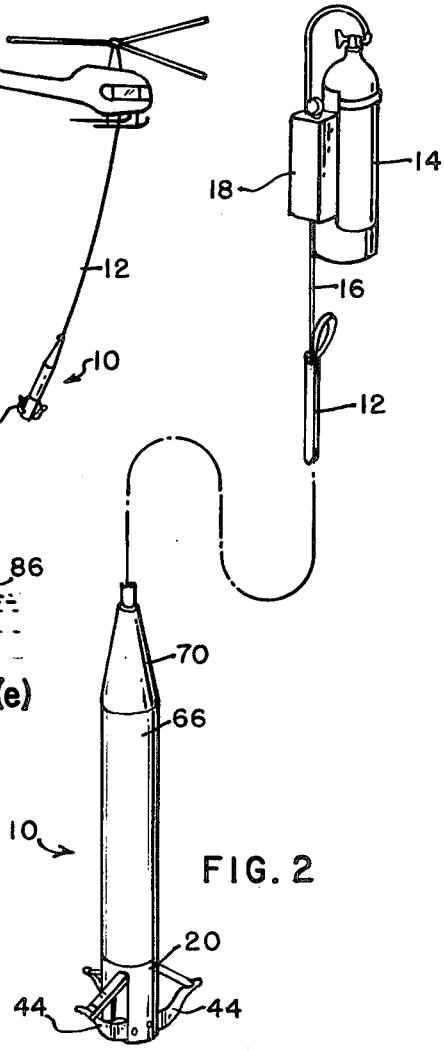
FIG. 2 illustrates an isometric view of the grapnel hook apparatus and fluid pressure tank.

Referring now to the drawings wherein like reference numerals designate like or similar parts throughout the several views, there is illustrated in FIG. 2 a remotely controlled cyclic grapnel hook apparatus 10 which may be lowered and towed from an aircraft, such as a helicopter, by a pendent 12. In the helicopter there may be located a pressure tank 14 which has a fluid pressure hose 16 and a control valve 18 for purposes to be described hereinafter. The fluid pressure hose 16 may be disposed within the sling lanyard 12 and extend into the hook apparatus 10 to a location which will also be disclosed hereinafter.

As illustrated in FIG. 3, the hook apparatus may include a cylinder 20 which has a top and a bottom, the cylinder having a central bore 22 axially therethrough and a counterbore 24 in its top portion. There is provided a piston 26, which has a top and a bottom, and a piston rod 28 which is centrally connected to the bottom of the piston 26. The piston 26 is slidably mounted in the cylinder counterbore 24, and the piston rod 28 is slidably mounted in the cylinder bore 22 therebelow. Means, such as a compression spring 30 mounted in the counterbore 24, may be utilized for downwardly biasing the piston 26 and piston rod 28. The spring 30 may be restrained at its top by a plate 32 which is rigidly connected to the top of the cylinder 20 by a series of bolts 34.

The cylinder 20 has a passageway 36 to one side of the counterbore 24, the passageway extending to the bottom of the counterbore 24 so that fluid pressure, preferably pneumatic pressure, can be applied or released at the bottom of the counterbore for moving the piston 26 and the piston rod 28 up or down in the cylinder 20 against the force of the spring 30. The bottom of the piston 26 may be provided with an annular notch 38 for providing a pressure area for receiving the fluid when the piston is in a completely down position. Means, such as an O-ring 40 within the piston 26, may be provided for slidably sealing the piston 26 to the counterbore 24 at a location above the bottom of the counterbore. Further, means, such as an O-ring 42 within the bore 22, may be provided for slidably sealing the piston rod 28 to the bore 22 below the bottom of the counterbore 24. The O-rings 40 and 42 provide a seal for the fluid pressure as the piston 26 and piston rod 28 reciprocate within counterbore 24 and bore 22, respectively.

Figures 7, 8:
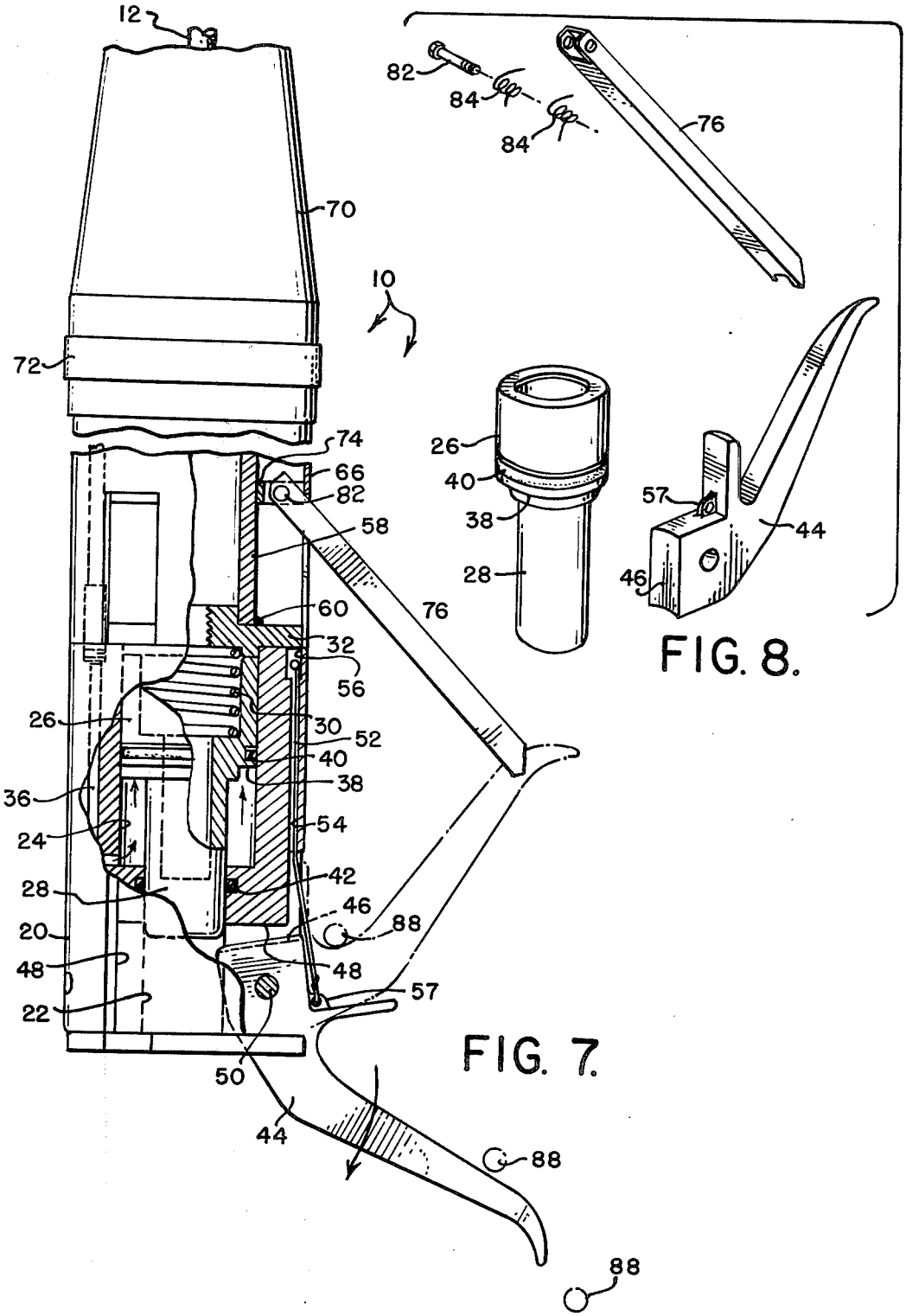
FIG. 7 is a view similar to FIG. 3 except the hook is shown in a down load releasing position.

At least one hook 44 is pivotally mounted to the bottom of the cylinder 20 so as to extend outwardly therefrom and swing up and down between the positions illustrated in FIG. 7. Preferably, a plurality of such hooks 44 are mounted on the cylinder 20 as illustrated in FIG. 2. Each hook 44 may be provided with an inwardly facing camming surface 46 which is engageable with the side of the piston rod 28 when the piston rod is in a down position. With this arrangement the hooks 44 would be locked in their upward load carrying positions when the piston rod 28 is in the downward position, as illustrated in FIG. 3, and are free to pivot downwardly to a load releasing position when the piston rod 28 is moved upwardly, as illustrated in FIG. 7. The up movement of the piston rod 28 is accomplished by applying fluid pressure through the passageway 36 to the bottom of the piston 26, and the downward movement of the piston rod 28 is accomplished by releasing this pressure and allowing the compression spring 30 to bias the piston rod 28 to the down position. The hooks 44 may be pivotally mounted to the cylinder 20, as stated hereinabove, by providing the bottom of the cylinder with longitudinal notches 48, and pins 50 extending through both the cylinder and each respective hook 44.

Spring means, such as a resilient cord 52, may be provided for biasing each respective hook to the upward load carrying position, as illustrated in FIG. 3, so that after the load is released from the hook, the hook will automatically return to the upward load carrying position (see FIG. 7). After the hook 44 is moved to the upward load carrying position fluid pressure can be released within the fluid passageway 36 so as to allow the piston rod 28 to move downwardly and once again lock the hook in the upward load carrying position (see FIG. 3). The cylinder 20 may be provided with a longitudinal passageway 54 which is counterbored at 56 for receiving the resilient cord 52. The top of the cord 52 may be knotted so as to be retained in the counterbore 56 and the bottom of the cord 52 may be looped through an eye 57 on the hook 44 and tied on itself with lacing cord. With this arrangement the cord 52 is shielded from outside forces and impacts, and yet can perform its intended function.

In order to transfer the load on the hook cylinder 20 to the pendent 12 and thence to the aircraft, a tube 58 may be axially connected to the top of the cylinder 20. This connection may be accomplished by fillet welding the bottom of the tube 58 to the top of the plate 32. A pin 62 may extend transversely through the top of the tube 58 for receiving the bottom looped portion of the pendant 12. The top portion of the pendant 12 also has a loop (see FIG. 2) which may be secured to the helicopter or other aircraft. The fluid pressure line 16 extends from the pressure tank 14 (see FIG. 2 ) downwardly within the pendant 12 and exits from a bottom portion of the pendent for connection to the passageway 36 at a fitting 64. The valve 18 is a three way valve for either applying pressure or relieving pressure to the bottom of the piston 26.

Surrounding the load carrying tube 58 is a tubular shroud 66 which may be coextensive with the outside cylindrical surface of the cylinder 20. The bottom of the shroud 66 may be secured to the cylinder 20 by screws 68 (see FIG. 5) which extend through the shroud and into the plate 32. A conical shroud portion 70 may be mounted on top of the shroud 66 and may be secured thereto by a clamp or simply electrical tape 72.

A second plate 74 may be mounted above the plate 32 for pivotally supporting a plurality of keeper arms 76. The plate 74 may be secured in place by screws 78 (see FIG. 4) which extend through the shroud 66 and into the plate. The plate is provided with notches 80 and bolts 82 for pivotally supporting the keeper arms 76 between upward and downward positions, as illustrated in FIG. 3. The bottom of each keeper arm engages a top portion of each respective hook 44 and is maintained in this upward position by a torsion spring 84 about each respective bolt 82. As illustrated in FIG. 1, a cargo package 86 floating on the surface of the water may be provided with an upstanding loop 88. When this loop 88 is received by one of the hooks 44 the keeper arm 76 is biased downwardly against the respective spring 84 allowing the loop 88 to be received onto the hook 44, but yet preventing the loop from exiting the hook until the hook is dropped to its downward load releasing position, as illustrated in FIG. 7.

OPERATION OF THE INVENTION

An exemplary operation of the present invention is illustrated in FIG. 1 wherein a helicopter is shown towing the present hook apparatus 10 by the pendant 12. As the helicopter slowly passes over the cargo package 86, one of the hooks 44 will in all probability hook the loop 88, as illustrated in FIG. 1*b*, at which time the keeper arm moves first inwardly to allow receipt of the hook and then moves outwardly to retain the loop 88 on the respective hook (see FIG. 7). The helicopter can then ascend, as illustrated in FIG. 1*c* to carry the cargo package 86 to another location where it is desired to place the cargo package. When this location is reached the helicopter operator operates the valve 18 (see FIG. 2) to apply a pressure at the bottom of the piston 26 to push the piston rod 26 and the piston rod 28 upwardly (see FIG. 7) allowing the weight of the cargo 86 to force the hook downwardly to release the load and drop it to the ocean's surface as illustrated in FIG. 1*d*. After the load is dropped the resilient cord 52 immediately biases the hook to its upward load carrying position again, after the hook 44 is in its upward position the helicopter operator then simply operates the valve 18 (see FIG. 2) to release the pressure at the bottom of the piston 26 so as to allow the spring 30 to force the piston rod 28 downwardly and once again lock all of the hooks 44 in their upward load carrying positions (see FIGS. 2 and 3). The hook assembly 10 is now readied for additional hooking, carrying, and releasing of other payloads, all operations being remotely controlled by the helicopter operator.

Obviously, many modifications and variations of the present invention are possible in the light of the above teachings, and, it is therefore understood that within the scope of the disclosed inventive concept, the invention may be practiced otherwise than as specifically described.

What is claimed is:

1. A remotely controlled cyclic grapnel hook apparatus comprising:

a cylinder which has a top and a bottom;

said cylinder having a central bore axially therethrough and a counterbore in its top portion;

a piston having a top and a bottom;

a piston rod centrally connected to the bottom of the piston;

said piston being slidably mounted in the cylinder counterbore and the piston rod being slidably mounted in the cylinder bore therebelow;

means for downwardly biasing the piston and piston rod;

the cylinder having a passageway to the bottom of the counterbore so that fluid pressure can be applied or released therein for moving the piston and piston rod up or down in the cylinder against the force of the spring means;

at least one hook pivoted to the bottom of the cylinder so as to extend outwardly therefrom; and said hook having a camming surface which engages the side of the piston rod so that the hook is locked in an upward load carrying position when the piston rod is in a downward position and is free to pivot downwardly to a load releasing position when the piston rod is moved upwardly.

2. An apparatus as claimed in claim 1 including:

means slidably sealing the piston to the counterbore above the bottom of the counterbore; and means slidably sealing the piston rod to the bore below the bottom of the counterbore.

3. An apparatus as claimed in claim 1 wherein the downwardly biasing means includes:

a compression spring disposed within the counterbore above the piston; and stop means disposed in the bore for engaging the top of the compression spring in a compressed condition against the piston.

4. An apparatus as claimed in claim 1 including:

a keeper arm pivoted to the cylinder in line with the hook; and means biasing the keeper arm downwardly against the hook for retaining a load on the hook.

5. A remotely controlled cyclic grapnel hook apparatus comprising:

a cylinder which has a top and a bottom;

said cylinder having a central bore axially therethrough and a counterbore in its top portion;

a piston having a top and a bottom;

a piston rod centrally connected to the bottom of the piston;

said piston being slidably mounted in the cylinder counterbore and the piston rod being slidably mounted in the cylinder bore therebelow;

means for downwardly biasing the piston and piston rod;

the cylinder having a passageway to the bottom of the counterbore so that fluid pressure can be applied or released therein for moving the piston and piston rod up or down in the cylinder against the force of the spring means;

at least one hook pivoted to the bottom of the cylinder so as to extend outwardly therefrom;

said hook having a camming surface which engages the side of the piston rod so that the hook is locked in an upward load carrying position when the piston rod is in a downward position and is free to pivot downwardly to a load releasing position when the piston rod is moved upwardly; and spring means biasing the hook to the upward load carrying position so that after a load is released the hook will automatically return to the upward load carrying position, after which fluid pressure can be released allowing the piston rod to move downwardly and once again lock the hook in the upward load carrying position.

6. An apparatus as claimed in claim 5 including:

means slidably sealing the piston to the counterbore above the bottom of the counterbore; and means slidably sealing the piston rod to the bore below the bottom of the counterbore.

7. An apparatus as claimed in claim 6 wherein the downwardly biasing means includes:

a compression spring disposed within the counterbore above the piston; and stop means disposed in the bore for engaging the top of the compression spring in a compressed condition against the piston.

8. An apparatus as claimed in claim 7 including:

a keeper arm pivoted to the cylinder in line with the hook; and means biasing the keeper arm downwardly against the hook for retaining a load on the hook.

9. An apparatus as claimed in claim 8 including:

a plurality of said hooks pivotally mounted about the bottom of the cylinder; and a keeper arm biased against each respective hook.

* * * * *